US009347640B2

(12) United States Patent
Chang et al.

(10) Patent No.: US 9,347,640 B2
(45) Date of Patent: May 24, 2016

(54) ILLUMINATING DEVICE

(75) Inventors: Hsueh-Chih Chang, Changhua County (TW); Sheng-Pan Huang, Changhua County (TW); Chiu-Ling Chen, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 1125 days.

(21) Appl. No.: 12/966,985

(22) Filed: Dec. 13, 2010

(65) Prior Publication Data

US 2011/0141744 A1 Jun. 16, 2011

(30) Foreign Application Priority Data

Dec. 15, 2009 (TW) ..... 98142842 A

(51) Int. Cl.
*F21V 1/00* (2006.01)
*F21V 7/00* (2006.01)
(Continued)

(52) U.S. Cl.
CPC ..... *F21V 1/00* (2013.01); *F21V 7/0025* (2013.01); *F21V 7/09* (2013.01); *F21Y 2101/02* (2013.01)

(58) Field of Classification Search
CPC ..... F21V 1/00; F21V 7/0025; F21V 7/09; F21V 13/04; F21V 11/00; F21V 13/08; F21V 13/10; F21V 5/00; F21V 5/04; F21V 5/048; F21Y 2101/02; F21Y 2101/00; F21Y 2103/003; F21Y 2105/008; F21Y 2111/001; G01N 2201/062; H01L 33/58; H01L 51/5275; H01L 33/54; B29L 2011/0016; F21K 9/30; F21K 9/56; F21K 9/135; G02B 1/041; G02F 1/133526; G03B 21/041; G03B 21/2033; H04N 9/045; F21S 10/00; F21S 48/115; F21S 48/125; F21S 48/1317; F21S 48/145; F41G 3/145; G09F 13/18; G09F 2013/222; G09F 23/04
USPC ..... 362/326, 327, 335, 346, 350, 351, 334, 362/311.02, 509–522, 291, 296.01–296.1, 362/230, 231, 235, 236, 240, 241, 247, 248, 362/249.01, 268
See application file for complete search history.

(56) References Cited

U.S. PATENT DOCUMENTS 6,961,190 B1 11/2005 Tamaoki et al.
7,114,827 B2 10/2006 Halter
(Continued)

FOREIGN PATENT DOCUMENTS

TW I305256 1/2009
TW M356049 5/2009
(Continued)

OTHER PUBLICATIONS

Taiwan Patent Office, Office Action, Patent Application Serial No. 098142842, Oct. 23, 2012, Taiwan.
(Continued)

*Primary Examiner* — Stephen F Husar
*Assistant Examiner* — Danielle Allen

(57) ABSTRACT

An illuminating device is provided. The illuminating device includes a light source and a lampshade. The light source provides a first light beam and a second light beam. The lampshade includes a first curved surface and a second curved surface. The first light beam is refracted by the first curved surface. The second light beam is reflected by the second curved surface, and a curvature of the first curved surface differs from a curvature of the second curved surface.

14 Claims, 8 Drawing Sheets

(51) Int. Cl.
*F21V 7/09* (2006.01)
*F21Y 101/02* (2006.01)

(56) References Cited

U.S. PATENT DOCUMENTS

| | | | | |
|---|---|---|---|---|
| 7,244,924 | B2 | 7/2007 | Kiyomoto et al. | |
| 7,283,313 | B2 * | 10/2007 | Tamaoki et al. | 359/726 |
| 7,295,592 | B2 | 11/2007 | Hirmatsu et al. | |
| 7,513,642 | B2 | 4/2009 | Sormani | |
| 2003/0007359 | A1 * | 1/2003 | Sugawara et al. | 362/326 |
| 2005/0168987 | A1 | 8/2005 | Tamaoki et al. | |
| 2008/0316761 | A1 * | 12/2008 | Minano et al. | 362/518 |
| 2009/0225551 | A1 * | 9/2009 | Chang et al. | 362/311.06 |

FOREIGN PATENT DOCUMENTS

| | | |
|---|---|---|
| TW | M358937 | 6/2009 |
| TW | 200938770 | 9/2009 |

OTHER PUBLICATIONS

Taiwan Patent Office, Notice of Allowance, Patent Application Serial No. 98142842, May 24, 2013, Taiwan.
Taiwan Patent Office, Office Action, Patent Application Serial No. 98142842, Feb. 5, 2013, Taiwan.

* cited by examiner

ILLUMINATING DEVICE

CROSS REFERENCE TO RELATED APPLICATIONS

This application claims priority of Taiwan Patent Application No. 098142842, filed on Dec. 15, 2009, the entirety of which is incorporated by reference herein.

BACKGROUND

1. Technical Field

The present disclosure relates to an illuminating device, and in particular relates to an illuminating device providing uniform illumination.

2. Related Art

FIG. 1 shows a conventional illuminating device 1, which is disposed on a supporting plate 2. The illuminating device 1 emits light beam 4 toward the ceiling 3. The light beam 4 is reflected by the ceiling 3, and scattered downward to provide illumination.

Conventionally, the light beam 4 is reflected centrally by an area A of the ceiling 3. The brightness contrast between the area A and an area B of the ceiling 3 is thus strong. The high brightness contrast provides discomfort to users, wherein users may feel illumination is insufficient. The distribution of brightness on a ceiling may be used to define indoor illumination uniformity. Conventionally, a min/avg brightness uniformity ratio of a ceiling is about 0.34, and a min/max brightness uniformity ratio of a ceiling is about 0.06.

SUMMARY

According to the disclosure, the illumination devices of the embodiments provide uniform illumination, decrease brightness contrast, and visual comfort.

An illuminating device is provided. The illuminating device includes a light source and a lampshade. The light source provides a first light beam and a second light beam. The lampshade includes a first curved surface and a second curved surface. The first light beam is refracted by the first curved surface. The second light beam is reflected by the second curved surface, and a curvature of the first curved surface differs from a curvature of the second curved surface.

An illuminating device is provided. The illuminating device includes a light source and a lampshade. The light source providing a first light beam, a second light beam, a third light beam and a fourth light beam. The lampshade includes a first curved surface, a second curved surface, a third curved surface and a fourth curved surface. The first light beam is substantially refracted by the first curved surface. The second light beam is substantially reflected by the second curved surface, and a curvature of the first curved surface differs from a curvature of the second curved surface. The third light beam is substantially reflected by the third curved surface. The fourth light beam is substantially refracted by the fourth curved surface, and a curvature of the third curved surface differs from that of the fourth curved surface.

An illuminating device is provided. The illuminating device provides illumination to a surface of a first body and a surface of a second body. The surface of the first body is substantially perpendicular to the surface of the second body. The illuminating device includes a light source and a lampshade. The light source provides a first light beam and a second light beam. The first light beam is substantially reflected by the first curved surface toward the surface of the first body. The second light beam is substantially reflected by the second curved surface toward the surface of the second body.

A detailed description is given in the following embodiments with reference to the accompanying drawings.

BRIEF DESCRIPTION OF THE DRAWINGS

The present disclosure can be more fully understood by reading the subsequent detailed description and examples with references made to the accompanying drawings, wherein.

DETAILED DESCRIPTION

The following description is of the best-contemplated mode of carrying out the disclosure. This description is made for the purpose of illustrating the general principles of the disclosure and should not be taken in a limiting sense.

Figure 1:
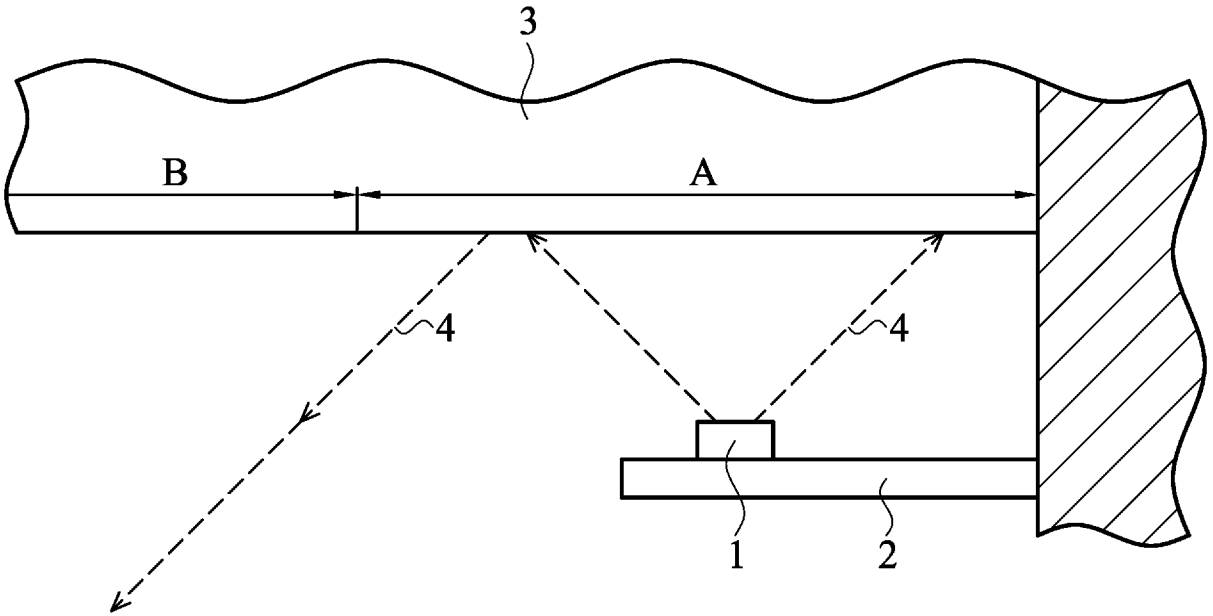
FIG. 1 (PRIOR ART)
FIG. 1 shows a conventional illuminating device.
Figure 2:
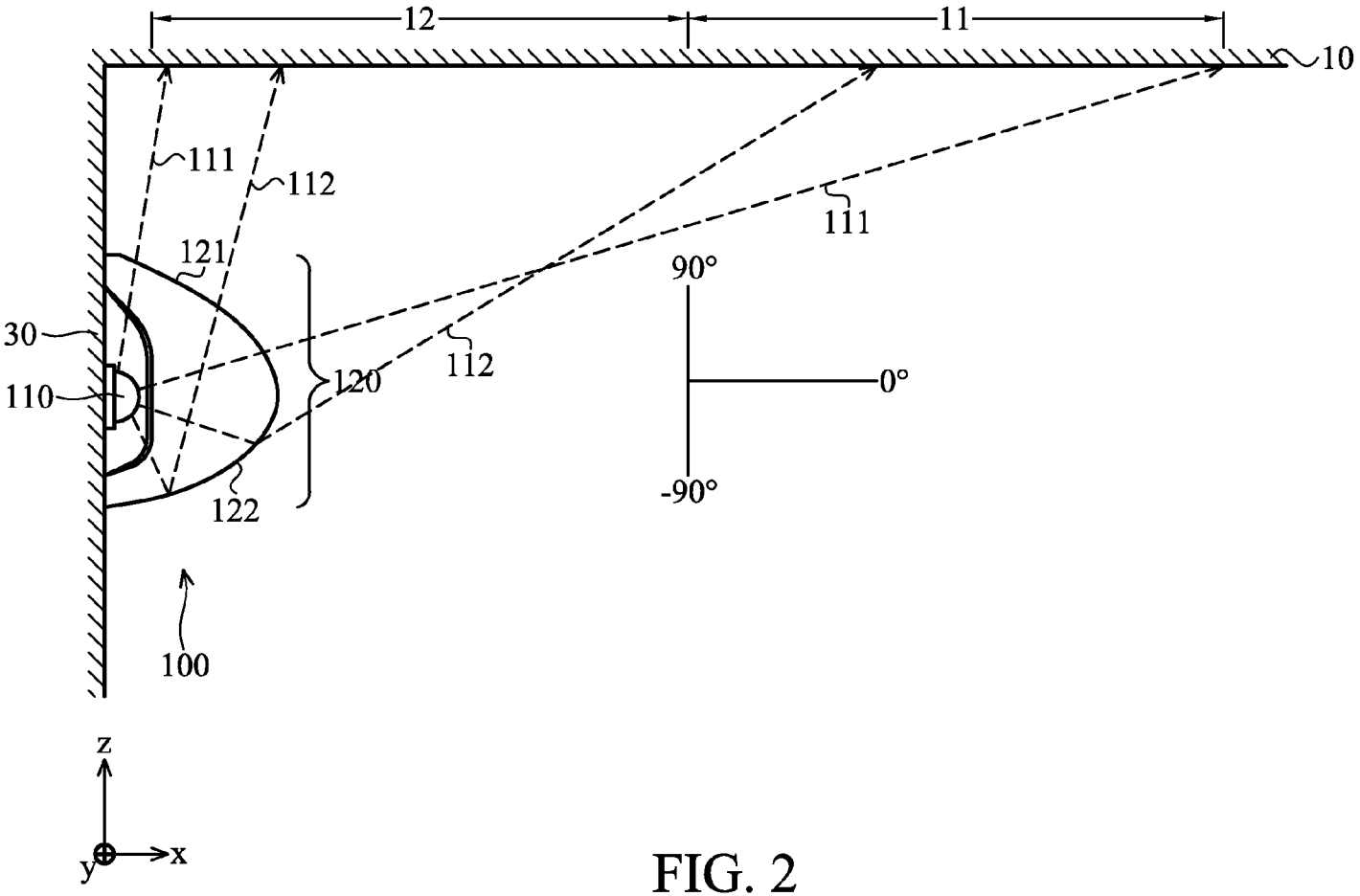
FIG. 2 shows an illuminating device of a first embodiment.

FIG. 2 shows an illuminating device 100 of a first embodiment. The illuminating device 100 includes a light source 110 and a lampshade 120. The light source 110 provides a first light beam 111 and a second light beam 112. The lampshade 120 includes a first curved surface 121 and a second curved surface 122. The first light beam 111 is substantially refracted by the first curved surface 121. The second light beam 112 is substantially reflected by the second curved surface 122. A curvature of the first curved surface 121 differs from that of the second curved surface 122. A light emitting angle of the first light beam 111 is between 90°~0°. A light emitting angle of the second light beam 112 is between 0°~−90°. In the embodiments, the light emitting angles are defined as an angle between the light beam and a normal line of the surface 30.

The illuminating device 100 is disposed in an inner space of a building. The space has a first body (ceiling, ground or wall) 10, and the first light beam 111 and the second light beam 112 are emitted to the first body (ceiling, ground or wall).

The illumination device of the first embodiment can uniformly distribute light over a first body. For example, in one embodiment, the first body (ceiling, ground or wall) 10 has a first light receiving area 11 and a second light receiving area 12. The first light receiving area 11 is adjacent to the second light receiving area 12. The second light receiving area 12 is relatively nearer the illuminating device 100 than the first light receiving area 11. The light beams with the light emitting angle between −60°~+60° are guided by the first curved surface or the second curved surface and projected to the first light receiving area. The light beams with the light emitting angle between −60°~+60° have high intensities, and is adapted for long distance projection to the first light receiving area 11. The first light beam with the light emitting angle between +60°~+90° and the second light beam with the light emitting angle between −60°~−90° are guided by the first curved surface or the second curved surface and projected to the second light receiving area 12. The first light beam with the light emitting angle between +60°~+90° and the second light beam with the light emitting angle between −60°~−90° have low intensities, and are adapted for short distance projection to the second light receiving area 12. The light is provided by the illumination device 100 can be uniformly projected to the first body (ceiling, ground or wall) 10, and reflected by the first body (ceiling, ground or wall) 10 to illuminate the space. Utilizing the illumination device 100 of the first embodiment of the invention, a min/avg brightness uniformity ratio of a ceiling is about 0.7, and a min/max brightness uniformity ratio of a ceiling is about 0.53. The illumination device 100 of the first embodiment decreases brightness contrast, provides uniform illumination, and provides visual comfort to users.

In one embodiment, a surface curvature of the first curved surface 121 is negative, and an absolute value of the surface curvature of the first curved surface is greater than a reciprocal of a distance between the light source 110 and the first curved surface 121. The first curved surface 121 substantially satisfies the following formula:

$$z=-0.11x^2+(5\times10^{-5})x^4+(-0.1)y^2+(-1.5\times10^{-3})y^4+(-1.5\times10^{-5})y^6$$

The x-y-z coordinates is defined as shown in FIG. 2.

A surface curvature of the second curved surface 122 is negative, and an absolute value of the surface curvature of the second curved surface is greater than a reciprocal of the distance between the light source 110 and the second curved surface 122. The surface curvature of the second curved surface 122 differs from the surface curvature of the first curved surface 121. The second curved surface 122 substantially satisfies the following formula:

$$z=-0.17x^2+(1.1\times10^{-3})x^4+(-6\times10^{-5})x^6+(-0.1)y^2+(-1.5\times10^{-3})y^4+(-1.5\times10^{-5})y^6$$

Figure 3:
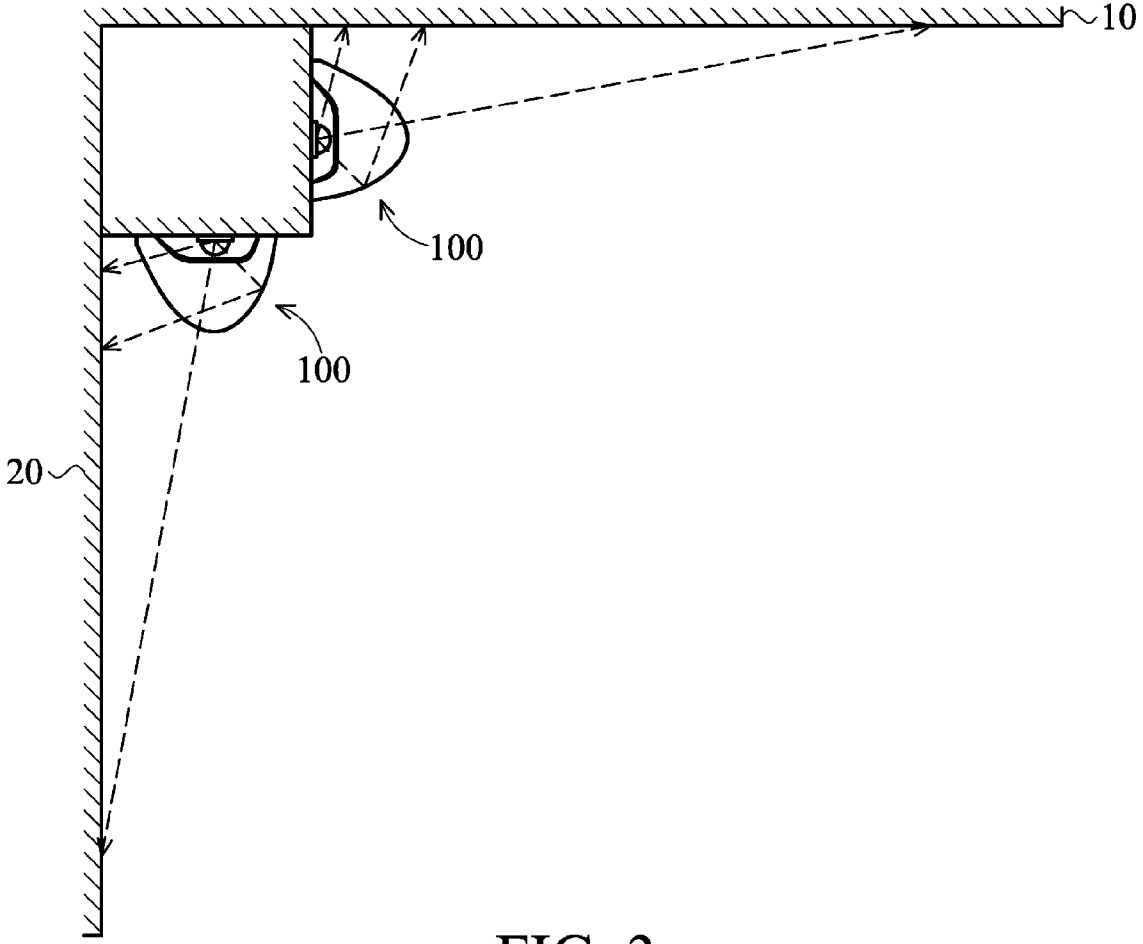
FIG. 3 shows a modified embodiment of the first embodiment.

FIG. 3 shows a modified embodiment of the first embodiment, wherein two illumination devices 100 respectively provide light beams to the first body (ceiling, ground or wall) 10 and a second body (wall or ceiling, ground) 20. The embodiment of FIG. 3 provides a greater amount of uniform illumination to the space.

Figure 4:
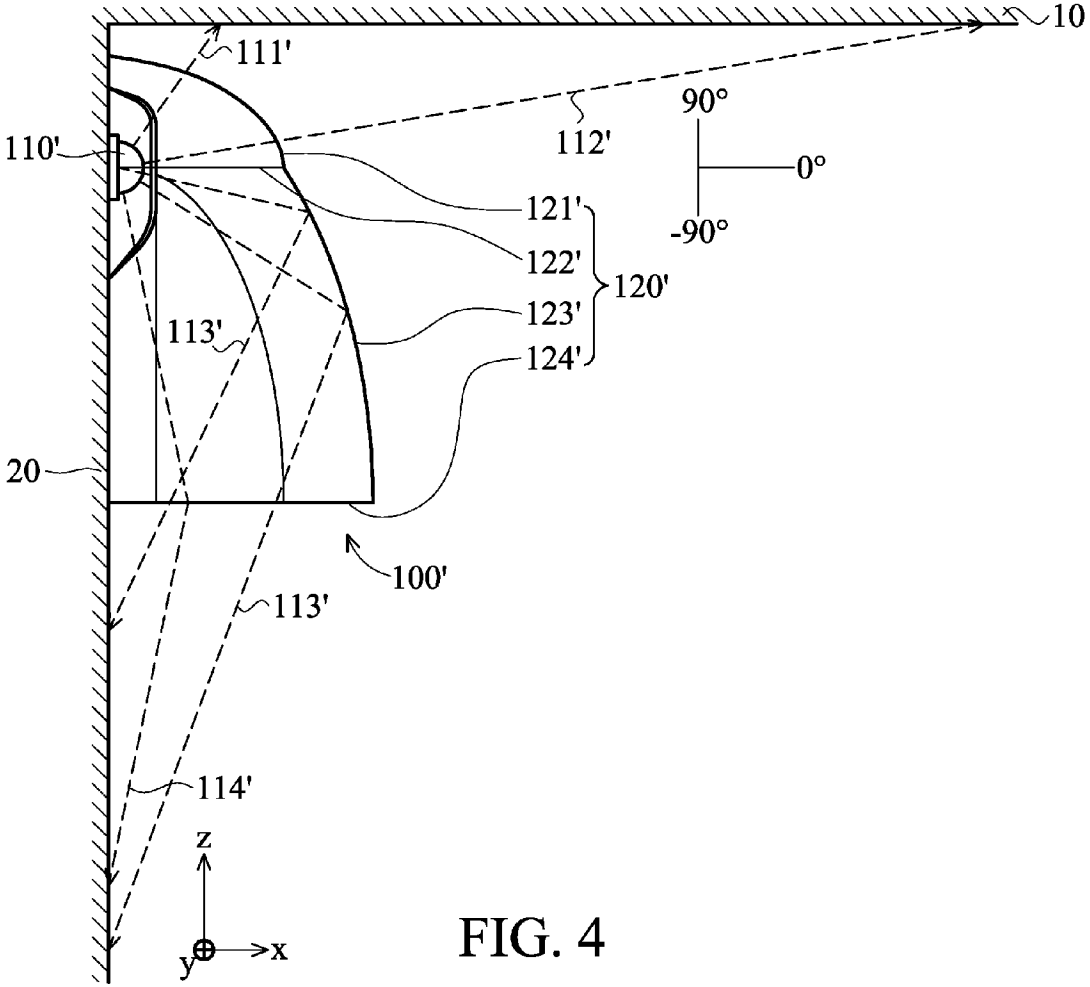
FIG. 4 shows an illuminating device of a second embodiment.
Figure 5:
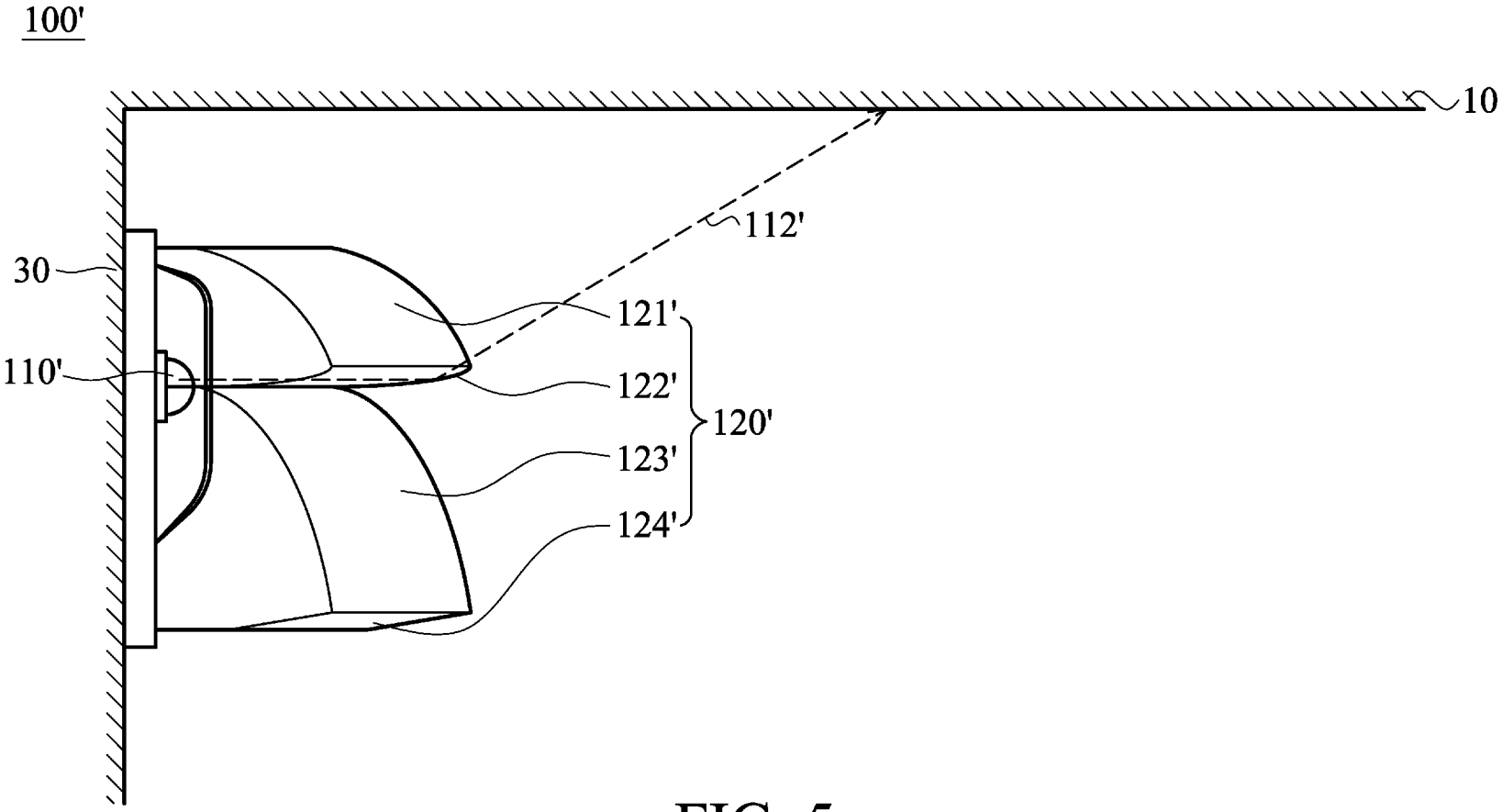
FIG. 5 is a perspective view of the illumination device of the second embodiment.

FIG. 4 shows an illuminating device 100' of a second embodiment. The illuminating device 100' includes a light source 110' and a lampshade 120'. The light source 110' provides a first light beam 111', a second light beam 112', a third light beam 113' and a fourth light beam 114'. The lampshade 120' includes a first curved surface 121', a second curved surface 122', a third curved surface 123' and a fourth curved surface 124'. The first light beam 111' is substantially refracted by the first curved surface 121'. The second light beam 112' is substantially reflected by the second curved surface 122' (refer to FIG. 5). A curvature of the first curved surface 121' differs from that of the second curved surface 122'. The third light beam 113' is substantially reflected by the third curved surface 123'. The fourth light beam 114' is substantially refracted by the fourth curved surface 124'. A curvature of the third curved surface 123' differs from that of the fourth curved surface 124'. FIG. 5 is a perspective view of the illumination device of the second embodiment, which shows a detailed structure of the second embodiment.

In the second embodiment, light emitting angles of the first light beam 111' and the second light beam 112' are between 90° ~0°. Light emitting angles of the third light beam 113' and the fourth light beam 114' are between 0°~90°. The space is formed by first body (ceiling, ground or wall) 10 and second body (wall or ceiling, ground) 20. The first light beam 111' and the second light beam 112' are projected to the first body (ceiling, ground or wall) 10. The third light beam 113 and the fourth light beam 114' are projected to the second body (wall or ceiling, ground) 20. The second body (wall or ceiling, ground) 20 is substantially perpendicular to the first body (ceiling, ground or wall) 10.

In the second embodiment, a surface curvature of the first curved surface 121' is negative, and an absolute value of the surface curvature of the first curved surface is greater than a reciprocal of the a distance between the light source 110' and the first curved surface 121'. The first curved surface 121' substantially satisfies the following formula:

$$z=-0.1x^2+(-3.7\times10^{-6})x^6+(-0.0)y^2+(1.1\times10^{-3})y^4+(-2.25\times10^{-5})y^6$$

A surface curvature of the second curved surface 122' is negative, and an absolute value of the surface curvature of the second curved surface is greater than a reciprocal of the a distance between the light source 110' and the second curved surface 122'. The surface curvature of the second curved surface 122' differs from the surface curvature of the first curved surface 121'. The second curved surface 122' substantially satisfies the following formula:

$$z=-3.5x^2+(-0.1)y^2+(1.1\times10^{-3})y^4+(-2.25\times10^{-5})y^6$$

A surface curvature of the third curved surface 123' can be positive or negative, and if the value is negative, an absolute value of the surface curvature of the third curved surface 123' shall be smaller than a reciprocal of the a distance between the light source 110' and the third curved surface 123'. The surface curvature of the third curved surface 123' differs from the surface curvatures of the first curved surface 121' and the second curved surface 122'. The third curved surface 123' substantially satisfies the following formula:

$$z=-0.06x^2+(1.8\times10^{-4})x^4+(-5.5\times10^{-7})x^6+10^{-10}x^8+(-0.1)y^2+(1.1\times10^{-3})y^4+(-2.25\times10^{-5})y^6$$

Utilizing the illumination device 100' of the second embodiment, the light beams provided thereby are uniformly reflected by a ceiling and a wall, and brightness contrast is further decreased. The illumination device 100' of the second embodiment provides uniform illumination, and provides visual comfort to users.

Figure 6:
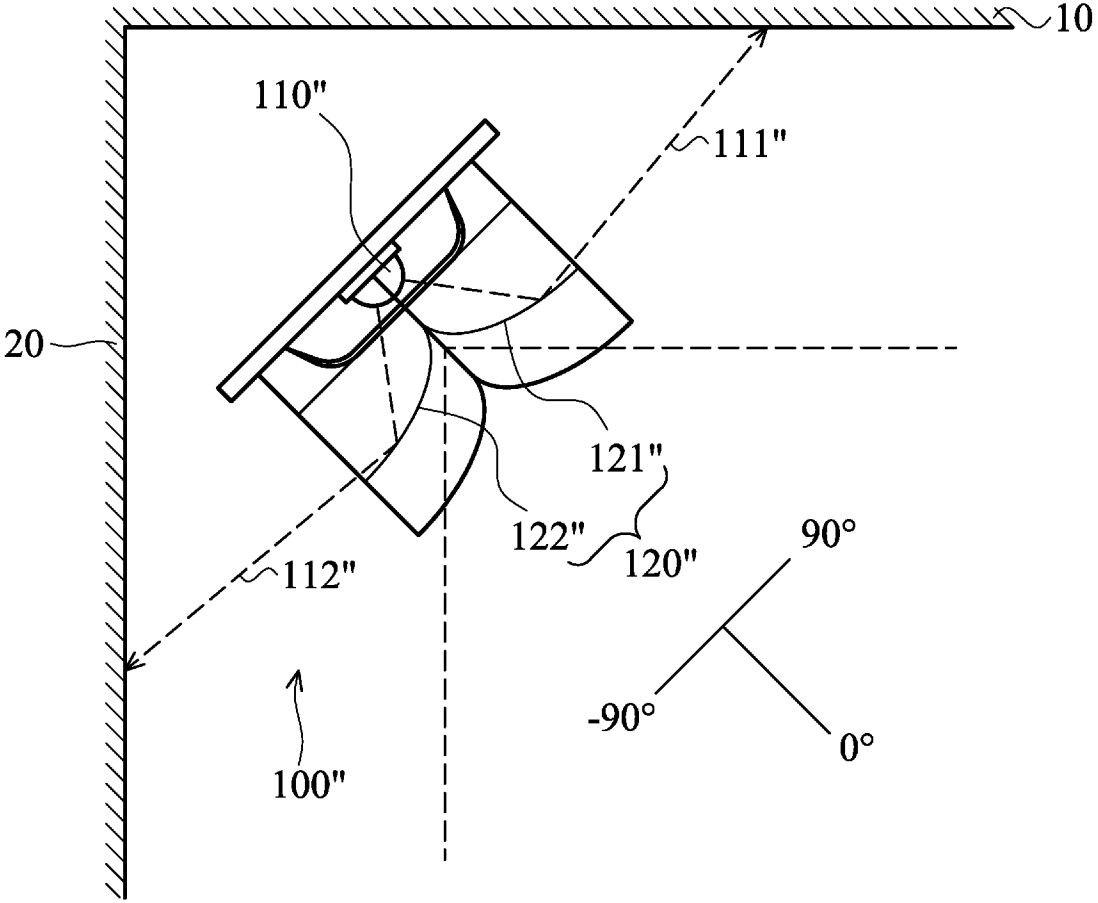
FIG. 6 shows an illuminating device of a third embodiment.

FIG. 6 shows an illuminating device 100" of a third embodiment. The illuminating device 100" includes a light source 110" and a lampshade 120". The light source 110" provides a first light beam 111" and a second light beam 112". The lampshade 120" includes a first curved surface 121" and a second curved surface 122". The first light beam 111" is substantially reflected by the first curved surface 121". The second light beam 112" is substantially reflected by the second curved surface 122". The first curved surface 121" is symmetric or asymmetric to the second curved surface 122". A light emitting angle of the first light beam 111" is between 90°~0°. A light emitting angle of the second light beam 112" is between 0°~−90°.

Utilizing the illumination device 100" of the third embodiment, the light beams provided thereby are uniformly reflected by a ceiling and a wall, and brightness contrast is further decreased. The illumination device 100" of the third embodiment provides uniform illumination, and provides visual comfort to users.

Figure 7A:
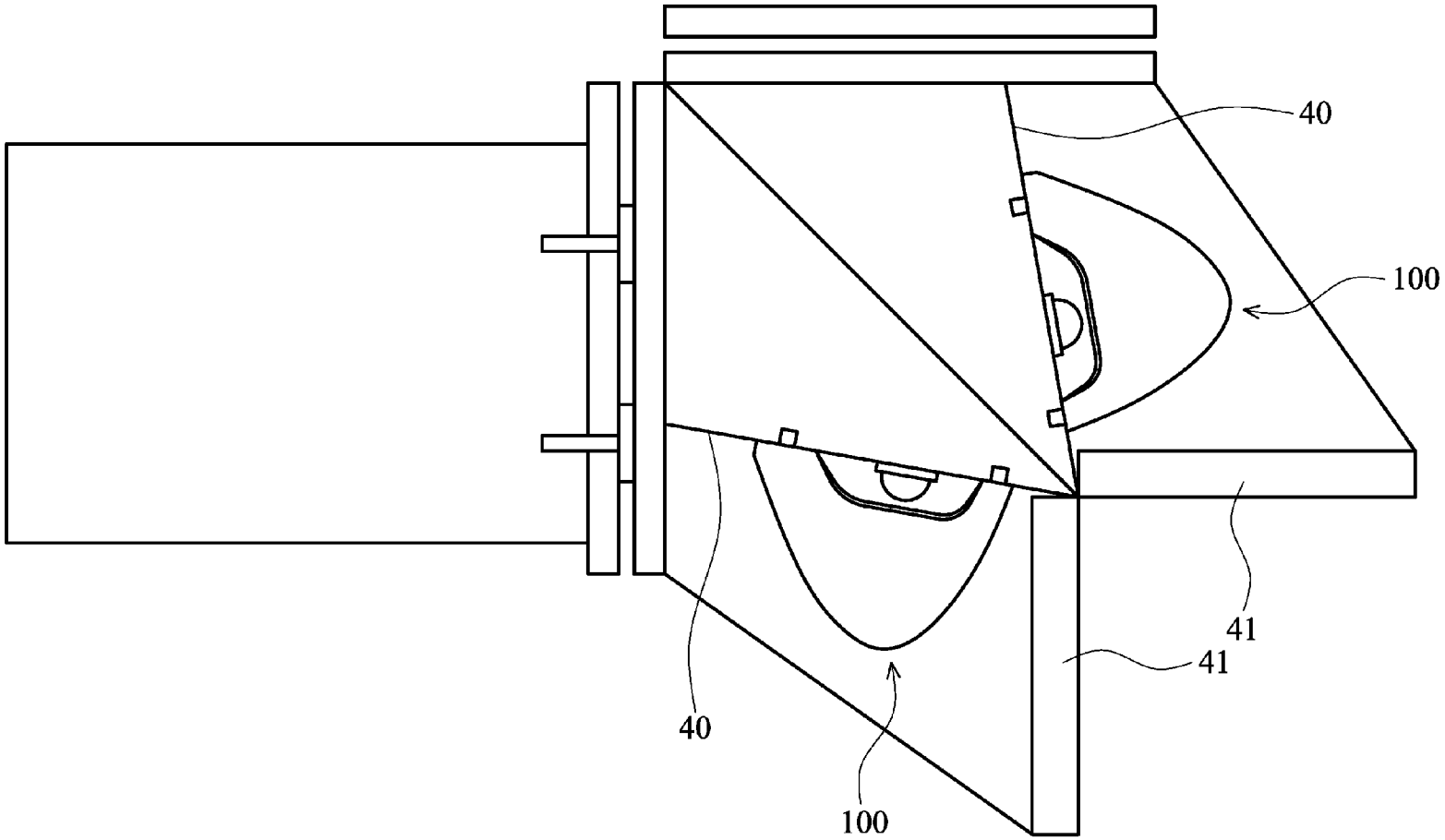
FIGS. 7A and 7B show a modified embodiment.
Figure 7B:
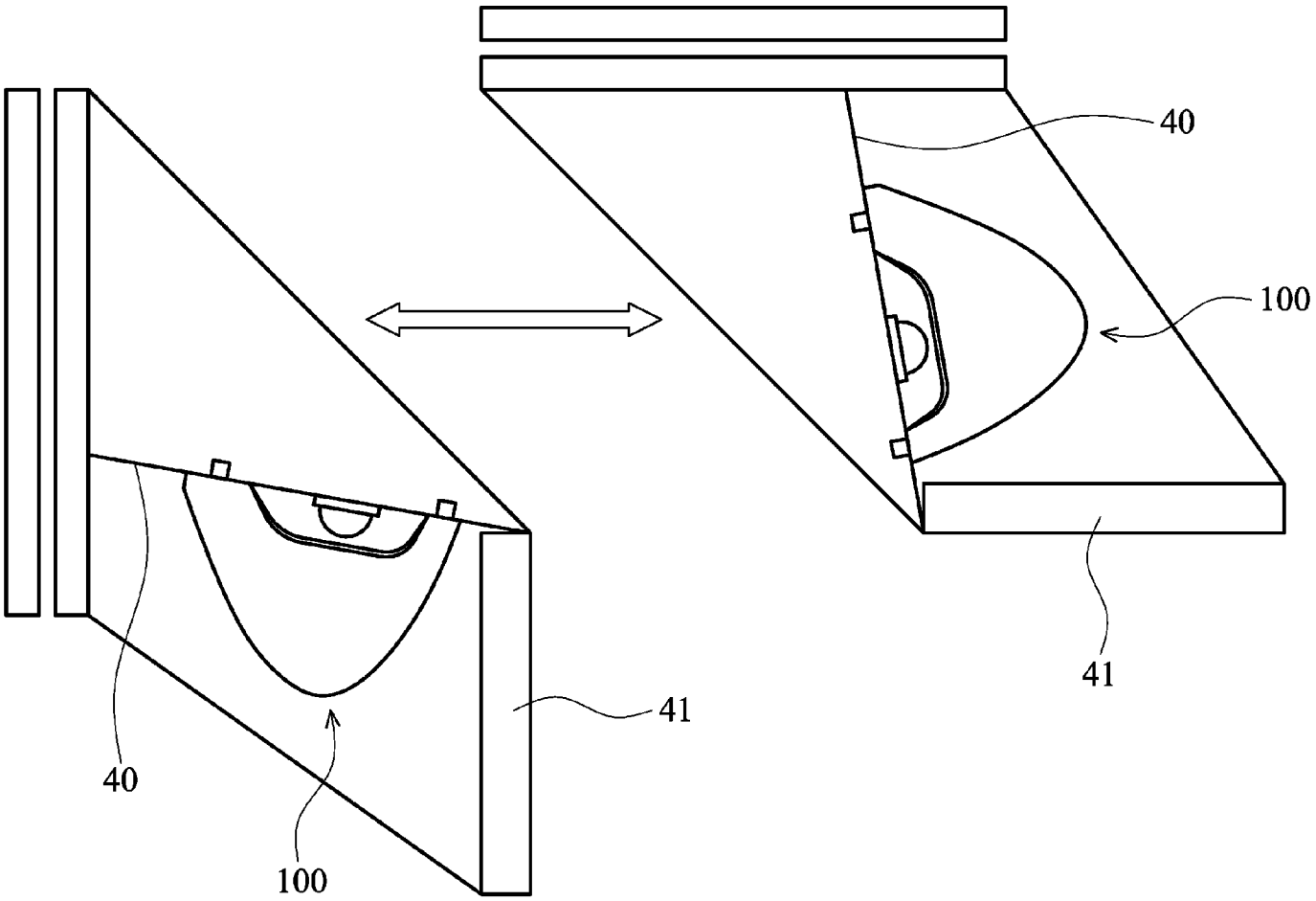

FIG. 7A shows a modified embodiment, wherein the illumination device 100 can be disposed on a heat sink 40 to dissipate the heat generated by the illumination device 100. Similar to the embodiment of FIG. 3, two illumination devices 100 respectively provide light beams to different surfaces to provide uniform illumination. Reflectors 41 can be disposed below the illumination devices 100. With reference to FIG. 7B, the two illumination devices 100 can be disposed on different base structures (heat sink), or, connected by other mechanisms.

In the embodiments above, the illuminating devices of the embodiments are utilized for indoor illumination. However, the invention is not limited thereby. The illuminating devices of the disclosure can be utilized in any illumination condition.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An illuminating device, comprising:

a light source; and a lampshade, comprising:

a first curved surface, wherein a curvature of the first curved surface is configured to refract light such that light emitted from the light source impinging the first curved surface is substantially refracted by the first curved surface; and a second curved surface, wherein a curvature of the second curved surface is configured to reflect light such that light emitted from the light source impinging the second curved surface is substantially reflected by the second curved surface, and a curvature of the first curved surface differs from a curvature of the second curved surface, wherein the light source and the lampshade are arranged such that light emitted from the light source at light emitting angles between +90°~−90° relative to a normal line of the light source is in part reflected and in part refracted by the first and the second curved surfaces to a surface of a first body extending in a direction parallel to the normal line at a position offset from the light source and having a first light receiving area and a second light receiving area, the first light receiving area being adjacent to the second light receiving area, and the second light receiving area being relatively nearer to the illuminating device than the first light receiving area;

arranged such that light emitted from light source emitted at light emitting angles between +60°~0° is refracted by the first curved surface and projected to the first light receiving area, light emitted from light source emitted at light emitting angles between 0°~−60° is reflected by the second curved surface and projected to the first light receiving area, light emitted from light source emitted at light emitting angles between +60°~+90° is refracted by the first curved surface and projected to the second light receiving area, and light emitted from light source emitted at light emitting angles between −60°~−90° is reflected by the second curved surface and projected to the second light receiving area, wherein the curvature of the first curved surface is negative, an absolute value of the curvature of the first curved surface is greater than a reciprocal of a distance between the light source and the first curved surface, wherein the curvature of the second curved surface is negative, an absolute value of the curvature of the second curved surface is greater than a reciprocal of a distance between the light source and the second curved surface.

2. The illuminating device as claimed in claim 1, wherein the first curved surface satisfies the following formula:

$$z=-0.11x^2+(5\times10^{-5})x^4+(-0.1)y^2+(-1.5\times10^{-3})y^4+(-1.5\times10^{-5})y^6.$$

3. The illuminating device as claimed in claim 1, wherein the second curved surface satisfies the following formula:

$$z=-0.17x^2+(1.1\times10^{-3})x^4+(-6\times10^{-5})x^6+(-0.1)y^2+(-1.5\times10^{-3})y^4+(-1.5\times10^{-5})y^6.$$

4. An illuminating device, comprising:

a light source; and a lampshade, comprising:

a first curved surface, wherein a curvature of the first curved surface is configured to refract light such that light emitted from the light source impinging the first curved surface is substantially refracted by the first curved surface;

a second curved surface, wherein a curvature of the second curved surface is configured to reflect light such that light emitted from the light source impinging the second curved surface the second light beam is substantially reflected by the second curved surface, and a curvature of the first curved surface differs from a curvature of the second curved surface;

a third curved surface, wherein a curvature of the third curved surface is configured to reflect light such that light emitted from the light source impinging third curved surface is substantially reflected by the third curved surface; and a fourth curved surface, wherein a curvature of the fourth curved surface is configured to refract light such that light emitted from the light source impinging fourth curved surface is substantially refracted by the fourth curved surface, and a curvature of the third curved surface differs from that of the fourth curved surface, arranged such that light refracted by the first curved surface and reflected by the second curved surface is emitted to a surface of a first body, and light reflected by the third curved surface and refracted by the fourth curved surface is emitted to a surface of a second body, and the surface of the second body is substantially perpendicular to the surface of the first body, wherein the curvature of the third curved surface is positive or negative, an absolute value of the curvature of the third curved surface is smaller than a reciprocal of a distance between the light source and the third curved surface, wherein the curvature of the third curved surface differs from the curvature of the first curved surface and the curvature of the second curved surface.

5. The illuminating device as claimed in claim 4, arranged such that light emitted from the light source and impinging on the first and second curved surfaces is emitted at light emitting angles between 90°~0° relative to a normal line of the light source.

6. The illuminating device as claimed in claim 4, arranged such that light emitted from the light source and impinging on the third and fourth curved surfaces is emitted at light emitting angles between −90°~0° relative to a normal line of the light source.

7. The illuminating device as claimed in claim 4, wherein the first curved surface satisfies the following formula:

$$z=-0.1x^2+(-3.7\times10^{-6})x^6+(-0.0)y^2+(1.1\times10^{-3})y^4+(-2.25\times10^{-5})y^6.$$

8. The illuminating device as claimed in claim 4, wherein the second curved surface satisfies the following formula:

$$z=-3.5x^2+(-0.1)y^2+(1.1\times10^{-3})y^4+(-2.25\times10^{-5})y^6.$$

9. The illuminating device as claimed in claim 4, wherein the third curved surface satisfies the following formula:

$$z=-0.06x^2+(1.8\times10^{-4})x^4+(-5.5\times10^{-7})x^6+10^{-10}x^8+(-0.1)y^2+(1.1\times10^{-3})y^4+(-2.25\times10^{-5})y^6.$$

10. An illuminating device for providing illumination to a surface of a first body and a surface of a second body, and the surface of the first body is substantially perpendicular to the surface of the second body, and the illuminating device comprises:

a light source; and a lampshade, comprising:

a first curved surface, wherein a curvature of the first curved surface is configured to reflect light such that light emitted from the light source impinging the first curved surface is substantially reflected by the first curved surface toward the surface of the first body; and a second curved surface, wherein a curvature of the second curved surface is configured to reflect light such that light emitted from the light source impinging the second curved surface is substantially reflected by the second curved surface toward the surface of the second body.

11. The illuminating device as claimed in claim 10, arranged such that light emitted from the light source and impinging on the first curved surface is emitted at light emitting angles between 90°~0° relative to a normal line of the light source.

12. The illuminating device as claimed in claim 10, arranged such that light emitted from the light source and impinging on the second curved surface is emitted at light emitting angles between 0° ~−90° relative to a normal line of the light source.

13. The illuminating device as claimed in claim 10, wherein the first curved surface is symmetric to the second curved surface.

14. The illuminating device as claimed in claim 10, wherein the first curved surface is non-symmetric to the second curved surface.

* * * * *